US006126340A

United States Patent [19]

Ono et al.

[11] Patent Number: 6,126,340

[45] Date of Patent: Oct. 3, 2000

[54] PRINTER

[75] Inventors: Kazuyasu Ono; Tomoaki Amano, both of Shizuoka, Japan

[73] Assignee: Star Micronics Co., Ltd., Shizuoka, Japan

[21] Appl. No.: 09/297,766

[22] PCT Filed: Oct. 29, 1997

[86] PCT No.: PCT/JP97/03941

§ 371 Date: May 7, 1999

§ 102(e) Date: May 7, 1999

[87] PCT Pub. No.: WO98/21043

PCT Pub. Date: May 22, 1998

[30] Foreign Application Priority Data

Nov. 8, 1996 [JP] Japan ..... 8-296725

[51] Int. Cl.[7] ..... B41J 3/42

[52] U.S. Cl. ..... 400/70; 400/76; 400/83; 235/7 R

[58] Field of Search ..... 400/70, 76, 83, 400/615.2; 235/7 R, 379, 380, 381, 383

[56] References Cited

U.S. PATENT DOCUMENTS

| | | | |
|---|---|---|---|
| 4,386,265 | 5/1983 | Sugimori | 235/2 |
| 4,589,069 | 5/1986 | Endo et al. | 364/405 |
| 4,790,504 | 12/1988 | Wills et al. | 248/183 |
| 4,893,237 | 1/1990 | Unno | 364/405 |
| 5,061,095 | 10/1991 | Asai et al. | 400/605 |
| 5,073,049 | 12/1991 | Numata et al. | 400/70 X |
| 5,081,579 | 1/1992 | Komai et al. | 364/405 |
| 5,227,966 | 7/1993 | Ichiba | 364/405 |
| 5,233,167 | 8/1993 | Markman et al. | 235/375 |
| 5,294,204 | 3/1994 | Clary | 400/636 |
| 5,347,451 | 9/1994 | Fujiwara et al. | 364/405 |
| 5,911,527 | 6/1999 | Aruga et al. | 400/74 X |

FOREIGN PATENT DOCUMENTS

| | | |
|---|---|---|
| 0 150 761 | 8/1985 | European Pat. Off. . |
| 62-150148 | 9/1987 | Japan . |
| 1-177694 | 7/1989 | Japan . |
| 1-133685 | 9/1989 | Japan . |
| 2-8781 | 3/1990 | Japan . |
| 4-265776 | 9/1992 | Japan . |
| 6-24048 | 2/1994 | Japan . |
| 7-23556 | 5/1995 | Japan . |

OTHER PUBLICATIONS

Pending U.S. Patent Application Serial No. 09/297,684, filed May 6, 1999, entitled "Recording Apparatus", by Kazuyasu Ono et al.

*Primary Examiner*—John S. Hilten
*Assistant Examiner*—Minh H. Chau
*Attorney, Agent, or Firm*—Wenderoth, Lind & Ponack, L.L.P.

[57] ABSTRACT

A printer 80 integrally comprises a printing section 81 for printing on a recording medium such as a cut sheet S and continuous paper L2 based on printing data transmitted from an external host unit H, a control panel 70 containing an indicator section for indicating operating states of the printing section 81, a display panel 60 for displaying data transmitted from the host unit H to the printing section 81 and instructed to be displayed, an interface 86 for transmitting/receiving signals between the host unit H and the printing section 81 and interfaces 87 and 62 for transmitting/receiving signals between the printing section 81 and the display panel 60. It is possible to securely prevent disagreement of printed content and displayed content and to realize down-sizing and simplification of the system structure by constructing a printer as described above.

12 Claims, 8 Drawing Sheets

PRINTER

BACKGROUND OF THE INVENTION

The present invention relates to a printer for printing on cut sheets, continuous paper and the like.

DESCRIPTION OF THE RELATED ART

A cut sheet such as an ordering slip and a receipt slip is called a slip sheet and there has been known a slip printer for printing on such sheets by manually supplying the sheet from the front or side of a printing section (for instance, Japanese Unexamined Utility Model Publication JP-U 62-150148 (1987), Japanese Examined Utility Model Publication JP-Y2 2-8781 (1990)).

Some shops and restaurants adopt a method of printing on the slip sheets at the payment of a charge by the slip printer set on a cashier counter with the use of information such as a name and unit price of the merchandise which are stored in a computer in advance. This method has an advantage such that a necessary number of duplicates of the slip sheet may be printed at the same time with the same contents for the shop, for a clerk and for a customer. A plurality of duplicates is often required also when payment is made by a credit card.

In addition to the slip printer, a printer for issuing a receipt needs to be provided because there are customers who ask for a receipt beside such a duplicate. However, because the cashier counter gets crowded when the same kinds of two printers are placed side by side, a combination printer in which both of the functions are combined is now on the way of development to cope with this problem.

Further, as a peripheral equipment of the computer, it is now being considered to construct a system for preventing a mistake in relation to the payment in which a display for confirmation is separately provided.

FIG. 9 is a block diagram showing an example of a prior art accounting system. A host unit 3 comprising a computer and additional devices stores a large amount of data such as a name and unit price of merchandise, and other data which are inputted from a keyboard, and the like or which are transmitted from another host unit.

A printer 1 is connected to the host unit 3 by a signal cable 4 in a serial transmission system such as RS232C and an Ethernet or in a parallel transmission system such as Centronics and SCSI. The printer 1 is provided with an interface 1*a* adapted to these transmission systems. When the host unit 3 transmits printing data and commands to the printer 1, the printer 1 analyzes the data and commands to execute a corresponding printing operation. The printer 1 has a power supply unit 1*b* and a power cable 1*c* to receive power from commercial power (e.g., 100 V AC).

A display unit 2 is connected with the host unit 3 by a signal cable 5 in the serial transmission system such as RS232C and is provided with an interface 2*a* adapted to the transmission system. When the host unit 3 transmits display data and commands to the display unit 2, the display unit 2 analyzes the data and the commands to execute a corresponding display operation. The display unit 2 has a power supply unit 2*b* and a power cable 2*c* to receive power from commercial power (e.g., 100 V AC).

Although the degree of freedom of the prior art system structure is high because the printer 1 and the display unit 2 are installed independently, this system structure requires a total of two power supply units and two signal cables. Therefore, when the host unit 3 is installed at the distant location, the signal cables become lengthy, and also the system occupies two power sockets.

Further, because the printer 1 and the display unit 2 are separate units, the total floor area increases and the cashier counter gets crowded when they are put on the cashier counter side by side.

Still more, when contents to be printed by the printer 1 are also to be displayed on the display unit 2, the host unit 3 needs to transmit relevant data to both the printer 1 and the display unit 2, with the result that the burden of the host unit 3 increases and there may arise a problem where data transmitted to the both are different from each other.

SUMMARY OF THE INVENTION

An object of the present invention is to provide a printer capable of securely preventing disagreement between printed contents and displayed contents, which accomplishes downsizing and simplification of the system structure.

The invention provides a printer comprising:

- a first interface section operable to electrically connect the printer with an external host unit;
- a first display section operable to display an operating state of the printer;
- a command identifying section operable to identify a command type of data transmitted from the external host unit;
- a printing data control section operable to process data which is determined as printing data by the command identifying section;
- a display data control section operable to process data which is determined as display data by the command identifying section;
- a printing mechanism operable to print on a recording medium based on the printing data from the printing data control section; and
- a second display section operable to display the display data from the display data control section.

According to the present invention, by providing the first display section operable to display the operating state of the printer and the second display section operable to display the display data, it is possible to display information for an operator of the printer, e.g., paper out, paper jam, on-line and off-line and other information, on the first display section and to display information for a person on the other side such as a customer, e.g., printed contents such as names and prices of the goods, on the second display section.

Furthermore, by identifying a command type of the data transmitted from the external host unit, it is possible to discriminate among printing data, display data and printing-display data, with the result that the external host unit can transmit display data following the same procedure as that in transmitting printing data and burdens of the operator and the external host unit can be reduced. Also the printer can execute the printing process and the displaying process solely or concurrently in response to such a command.

In the invention it is preferable that the printer further comprises a second interface operable to electrically connect the printer with the second display section and to exchange signals therebetween, and that the second display section is detachable from the second interface section.

According to the invention, since the second interface section for the second display section is provided between the printing section and the second display section and therefore the signal cable for connecting the external host unit with the first interface section suffices for connection with the external host unit, the cost will not increase even when the external host unit is installed at a distant location.

Furthermore, since the second display section is detachable from the body of the printer, it is possible to remove the second display section from the body of the printer when it is not necessary and the degree of freedom of the system structure is not decreased.

In the invention it is preferable that, when the data transmitted from the external host unit is determined as data which is used in common as both printing data and display data, the command identifying section transmits the same data to both the printing data control section and the display data control section.

According to the invention, it is possible to securely prevent disagreement between printed contents and display contents by using the data transmitted from the external host unit for both printing data and display data. Still more, since it is not necessary to transmit the same data many times, enhancements in the data transmission rate and a reduction in the data transmission time can be accomplished.

In the invention it is preferable that electric power to the second display section is supplied from a power circuit of a body of the printer.

According to the invention, since the second display section needs no power circuit and power cable and the number of parts is reduced, it is possible to accomplish downsizing and cost-reduction of the apparatus.

In the invention it is preferable that the printing mechanism contains a first printing unit operable to print on a cut sheet and a second printing unit operable to print on continuous paper.

According to the invention, since the printer can print on a plurality of kinds of paper such as cut sheets and continuous paper, it can print a duplicate of a slip sheet and issue a receipt at the same time and hence is suitable for an accounting system and other systems.

DETAILED DESCRIPTION OF THE PREFERRED EMBODIMENTS

Figure 1:
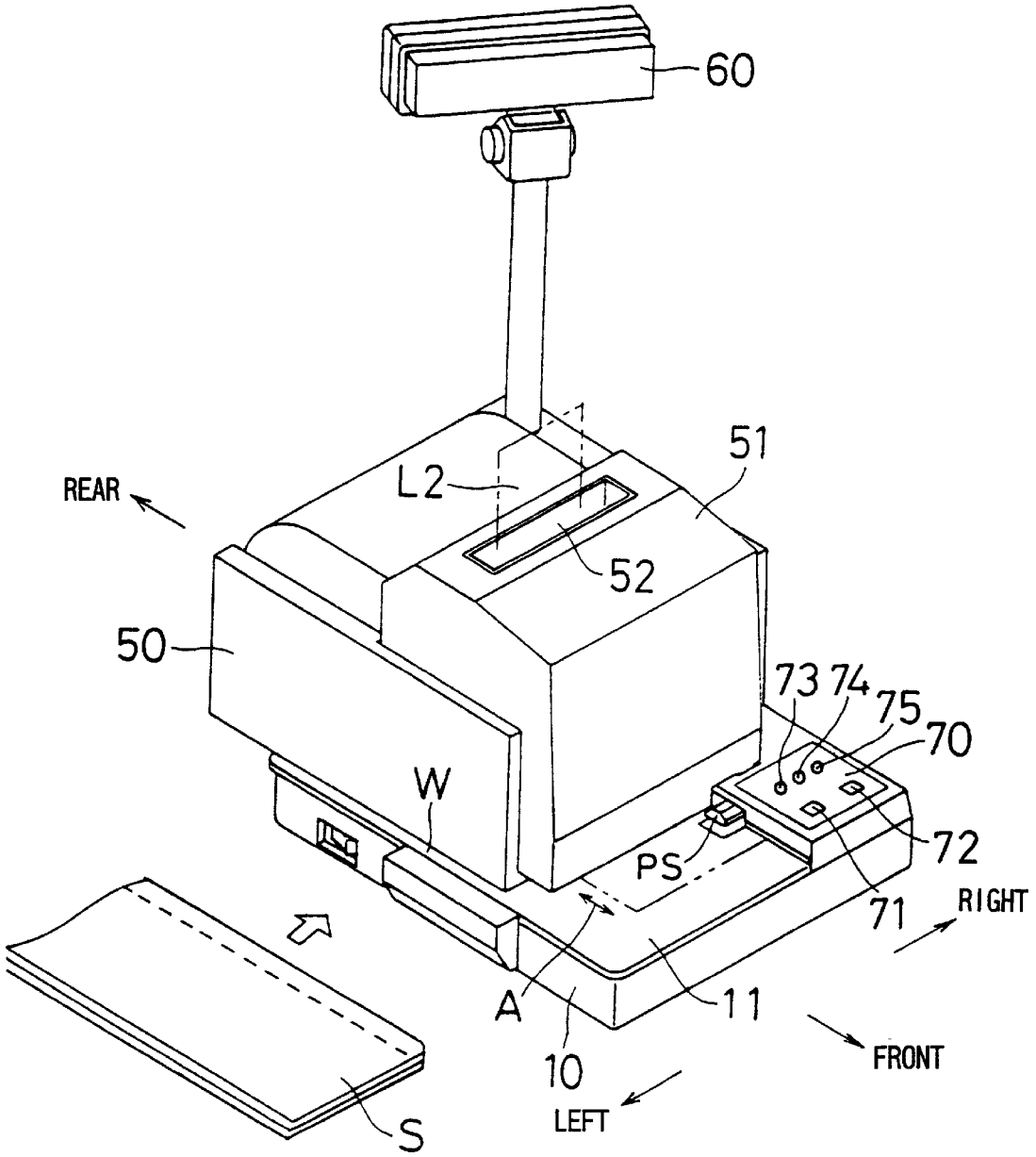
FIG. 1 is a perspective view showing a printer of the present invention.
Figure 2:
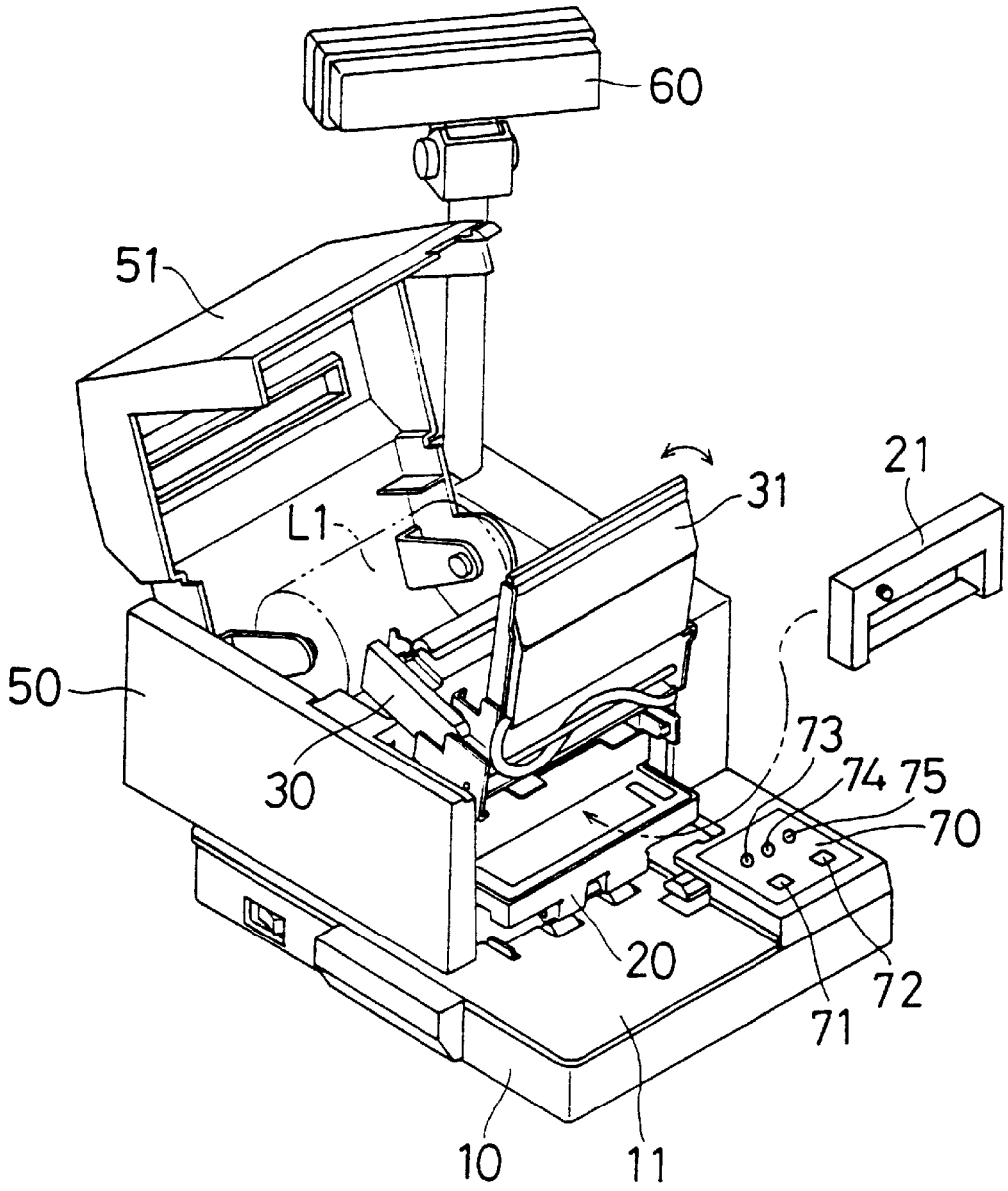
FIG. 2 is a perspective view showing the printer of the invention.
Figure 3:
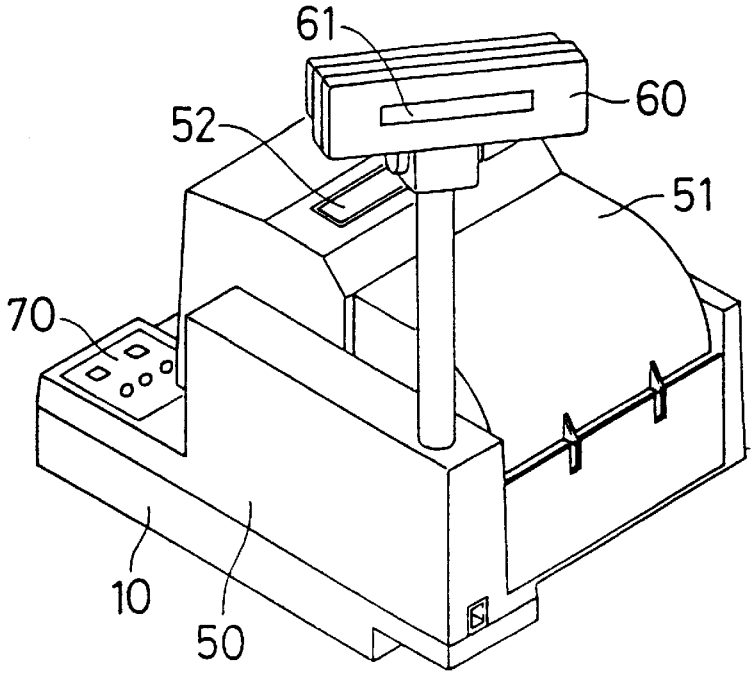
FIG. 3 is a perspective view showing the printer of the invention.
Figure 4:
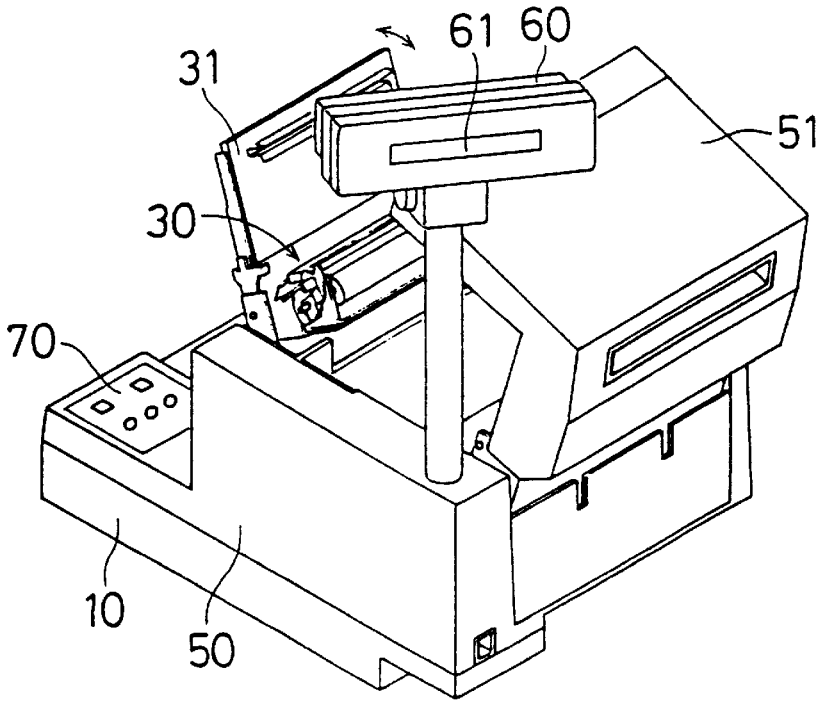
FIG. 4 is a perspective view showing the printer of the invention.

FIGS. 1 through 4 are perspective views showing a printer of the present invention, wherein FIG. 1 is a perspective view thereof, seen from the front left direction, in the state when a cover is closed, FIG. 2 is a perspective view thereof, seen from the front left direction, in the state when the cover is opened, FIG. 3 is a perspective view thereof, seen from the rear right direction, in the state when the cover is closed, and FIG. 4 is a perspective view thereof, seen from the rear left direction, in the state when the cover is opened.

In FIG. 1, the printer has a lower housing 10 and an upper housing 50. A cover 51 is pivotally supported at the rear end side of the upper housing 50. A discharge port 52 for discharging printed continuous paper L2 is formed at the upper surface of the cover 51.

A cut sheet S is composed of a plurality of duplicates and the like and is inserted from a slit opening W provided at the side of the apparatus or from the front side. After setting it on a table 11 having a horizontal plane, printing is carried out while conveying it in the direction of A. It is taken out from the opening W or the front side again after the printing.

A display panel 60 having a display section 61 for displaying data sent from the external host unit is provided so as face to the rear direction at the right rear corner of the printer as shown in FIG. 3. The display panel 60 is attached to be detachable and swingable and is turned toward the rear side to allow customers to confirm data when the printer is set on the cashier counter. The display section 61 comprises a dot-matrix or 7-segment liquid crystal panel, a light emitting diode array or the like.

A control panel 70 is provided at the front right side of the table 11 on the upper surface of the lower housing 10 and membrane type switches 71 and 72 and indicator lamps 73 through 75 of light emitting diode are disposed thereon. They function as follows. The printer starts a receipt issuing operation when the switch 71 is pressed and starts an operation for printing the cut sheet S when the switch 72 is pressed. When the indicator lamp 73 lights continuously, it indicates that the printer is in a power-on state and when the lamp flashes, it indicates that the cut sheet S is being conveyed in. When the indicator lamp 74 lights continuously, it indicates that the cut sheet S is being conveyed out and when the lamp flashes, it indicates a warning of the printer. When the display lamp 75 lights continuously, it indicates that the cut sheet S is released and when the lamp flashes, it indicates that the printer is off-lined with the external host unit.

As shown in FIG. 2, a printing unit 20 having an impact type printing head is provided above the table 11 and a ribbon cassette 21 is set removably thereon. A thermal recording printing unit 30 is provided above the printing unit 20 and a cutter unit 31 for cutting continuous paper L2 printed by the printing unit 30 is mounted thereon in a manner angularly displaceable. A wide space is assured when a cover 51 is opened. A roll of paper L1 for supplying the continuous paper L2 to the printing unit 30 is removably set therein.

Figure 5:
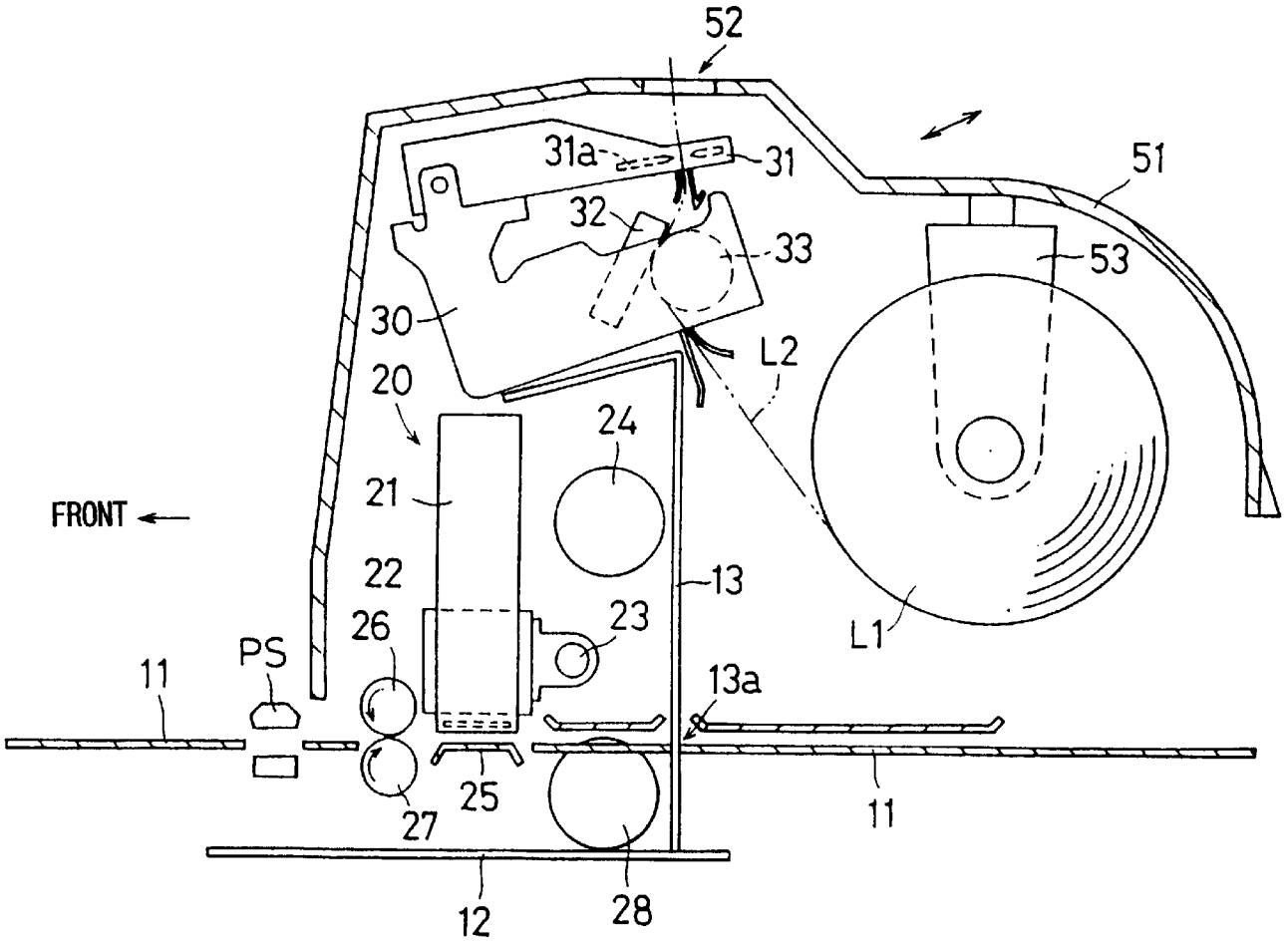
FIG. 5 is a diagram showing the internal structure of the printer.

FIG. 5 shows the internal structure of the printer. The table 11 for supporting the cut sheet S is provided horizontally. A transmission type photo sensor PS for detecting whether or not the cut sheet S exists and the edge thereof, rollers 26 and 27 for conveying the cut sheet S in the front and in the rear directions and a platen 25 facing to the printing head 22 are provided on the way of the path for transferring the cut sheet S. The rollers 26 and 27 are driven by a motor 28 via a transmission mechanism (not shown). The printing head 22 is held by a guide 23 so as to be able to reciprocate in the width direction (vertical to the surface of the figure) of the cut sheet S and is driven by a motor 24 via a transmission mechanism (not shown). The printing unit 20, constructed as described above, is mounted in front of a vertical frame 13.

The thermal recording printing unit 30 is mounted on the vertical frame 13 so that it comes above the printing unit 20 and comprises a printing head 32 composed of a line type thermal head 32 and a platen roller 33 therein. The cutter unit 31 for cutting the continuous paper L2 discharged out of the printing unit 30 is attached further above the printing unit 30 in an angularly displaceable manner and is provided with a cutter blade 31*a* therein. Because the cutter unit 31 cuts the continuous paper L2 automatically when the printing unit 30 ends its printing, it is possible to eliminate a tear bar or the like.

The cover 51 is pivotably supported in an angularly displaceable manner. The roll of paper L1 is removably held by a roll of paper holding member 53 integrally formed with the cover 51 so as to be coaxial with a rotation axis of the cover 51. The continuous paper L2 supplied from the roll of paper L1 is discharged out of a discharge port 52 formed at the upper surface of the cover 51 via the printing unit 30 and the cutter unit 31.

A floor area of the apparatus may be reduced considerably by disposing the printing unit 30 for printing the continuous paper L2 above the printing unit 30 for printing the cut sheet S as described above. Further, the roll of paper L1 is disposed behind the vertical frame 13 and the printing unit 30 is disposed at the upper side of the two-story structure, thereby the distance between the printing unit 30 and the roll of paper L1 may be kept long, thus facilitating the setting/removing the roll of paper and the inserting and attaching of the continuous paper. Still more, it is easy to take out receipts because the discharge port 52 of the continuous paper L1 is located near the front face of the apparatus and at the high position.

Figure 6:
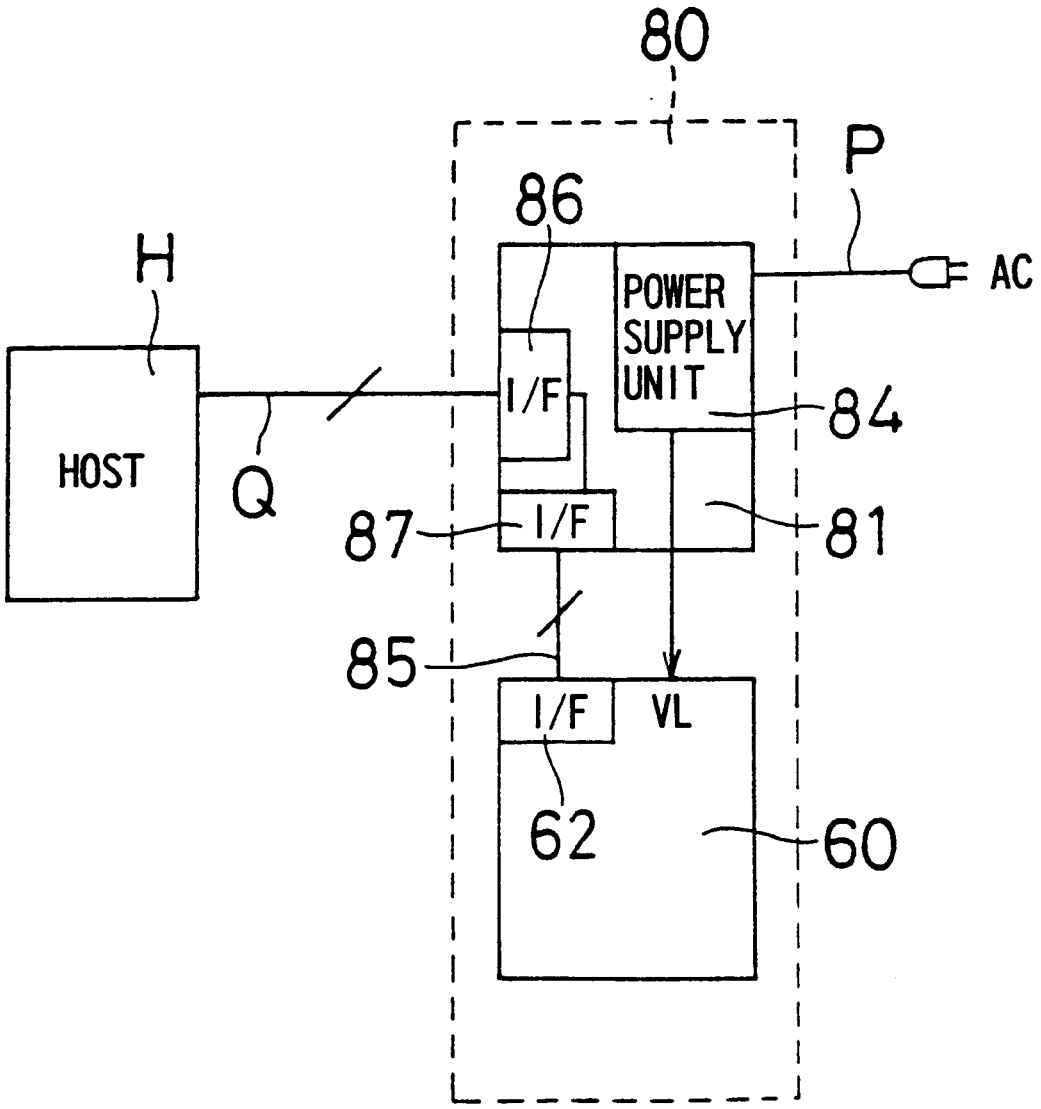
FIG. 6 is a block diagram showing a system structure using the printer of the invention.

FIG. 6 is a block diagram showing the structure of a system using the inventive printer. A host unit H comprising a computer and other devices stores a large amount of data such as a name and unit price of the merchandise, and other data which are inputted from a keyboard, a bar-code reader and the like or which are transmitted from another host unit.

A printer 80 is connected with the host unit H by a signal cable Q in the serial transmission system such as RS232C and Ethernet or in the parallel transmission system such as Centronics and SCSI. The printer 80 is provided with an interface 86 adapted to these transmission systems. The printer 80 is connected with the display panel 60 by a signal cable 85 in the serial transmission system in TTL level and the both are provided with interfaces 87 and 62 adapted to the transmission system. A connector (not shown) is provided on the way of the signal cable 85 to connect/disconnect the signal cable 85 in accordance with the attaching/detaching of the display panel 60.

The printer 80 has a power supply unit 84 and a power cable P to receive power from commercial power (e.g. 100 V AC). The display panel 60 receives power from the power supply unit 84.

Data is transmitted/received and power is supplied by the signal cable 85 between the printer 80 and the display panel 60. Because the printer 80 and the display panel 60 are connected by one connector, the display panel may be attached/detached readily and freely.

Figure 7:
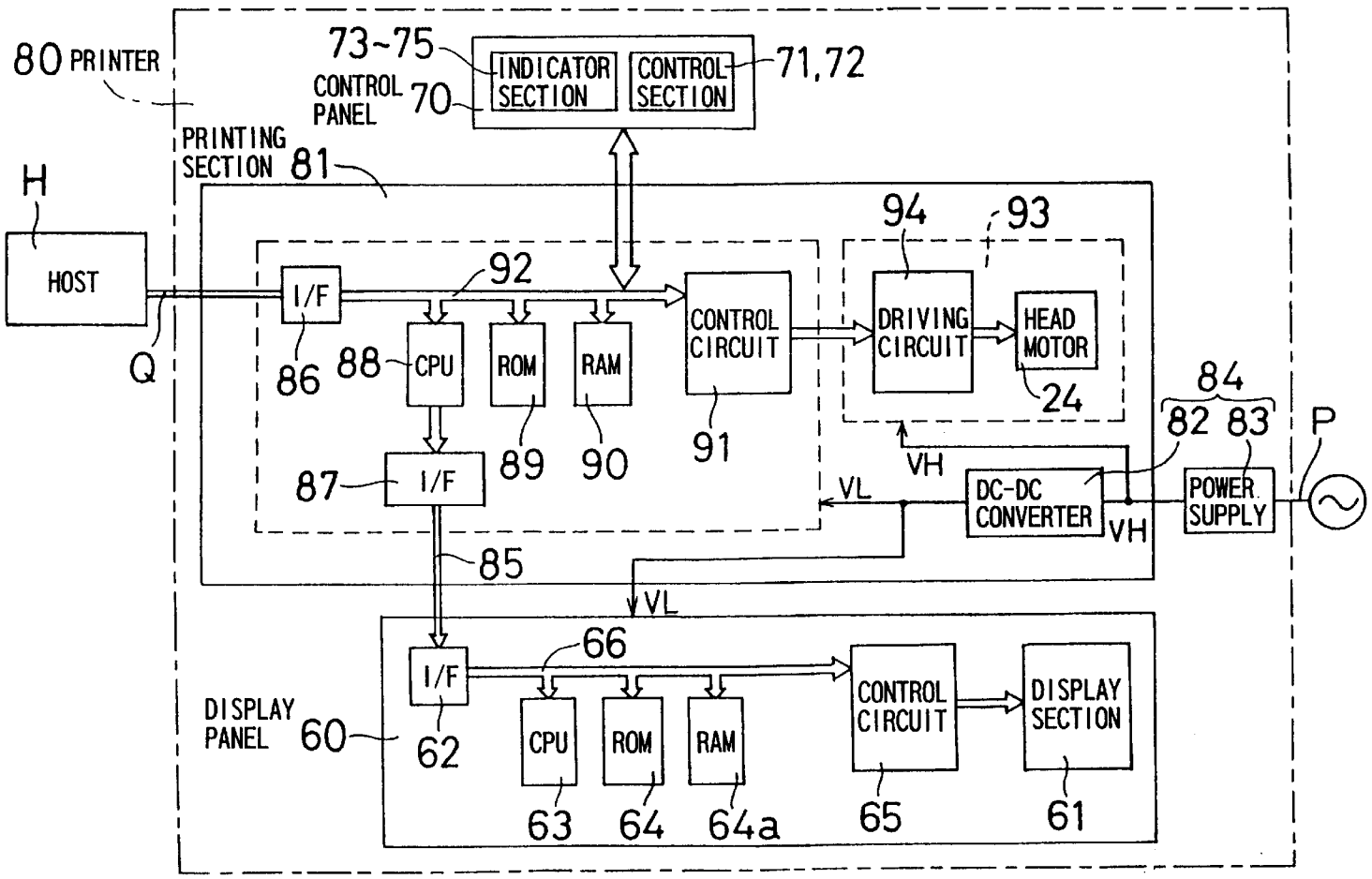
FIG. 7 is a block diagram showing the electrical structure of the printer 80.

FIG. 7 is a block diagram showing the electrical structure of the printer 80. The printer 80 integrally comprises a printing section 81 for printing on a recording medium based on printing data transmitted from the host unit H, a control panel 70 for displaying the operating state of the printing section 81 and the display panel 60 for displaying data transmitted from the host unit H to the printing section 81 and instructed to be displayed.

The printing section 81 comprises the interface 86 for transmitting/receiving signals between the host unit H, a CPU (central processing unit) 88 for controlling the operation of the printing section 81 based on a predetermined program, a ROM (read-only memory) 89 storing programs and data, a RAM (random access memory) 90 storing data temporarily, a control circuit 91 for controlling an operation of a printing mechanism section 93, a bus 92 for connecting them to each other, and the like. The interface 87 for transmitting/receiving signals between the display panel 60 is configured so as to be connected directly to the CPU 88.

The printing mechanism section 93 has the impact type printing head 22, the thermal recording printing head 32, the motors 24 and 28, the cutter unit 31, the photo sensor PS and others as shown in FIG. 5 (partly omitted in FIG. 7) and is provided with a driving circuit 94 for driving them.

The power supply unit 84 has a power circuit 83 for transforming voltage of and rectifying the commercial power supplied via the power cable P and generates power voltage VH (24 V DC for example) for the printing mechanism section 93. A DC—DC converter 82 at the latter stage converts the power voltage VH into power voltage VL (5 V DC for example) for logical circuits to supply to the logical circuits of the printing section 81 and the display panel 60.

The control panel 70 is connected electrically with a bus 92 of the printing section 81 and comprises a control section composed of the above-mentioned switches 71 and 72 and the display section composed of the indicator lamps 73 through 75.

The display panel 60 comprises the interface 62 for transmitting/receiving signals between the printing section 81, a CPU 63 for controlling the operation of the display panel 60 based on a predetermined program, a ROM 64 storing programs and data, a RAM 64 storing data temporarily, a control circuit 65 for controlling the operation of the display section 61, a bus 66 for connecting them to each other, and the like.

Figure 8:
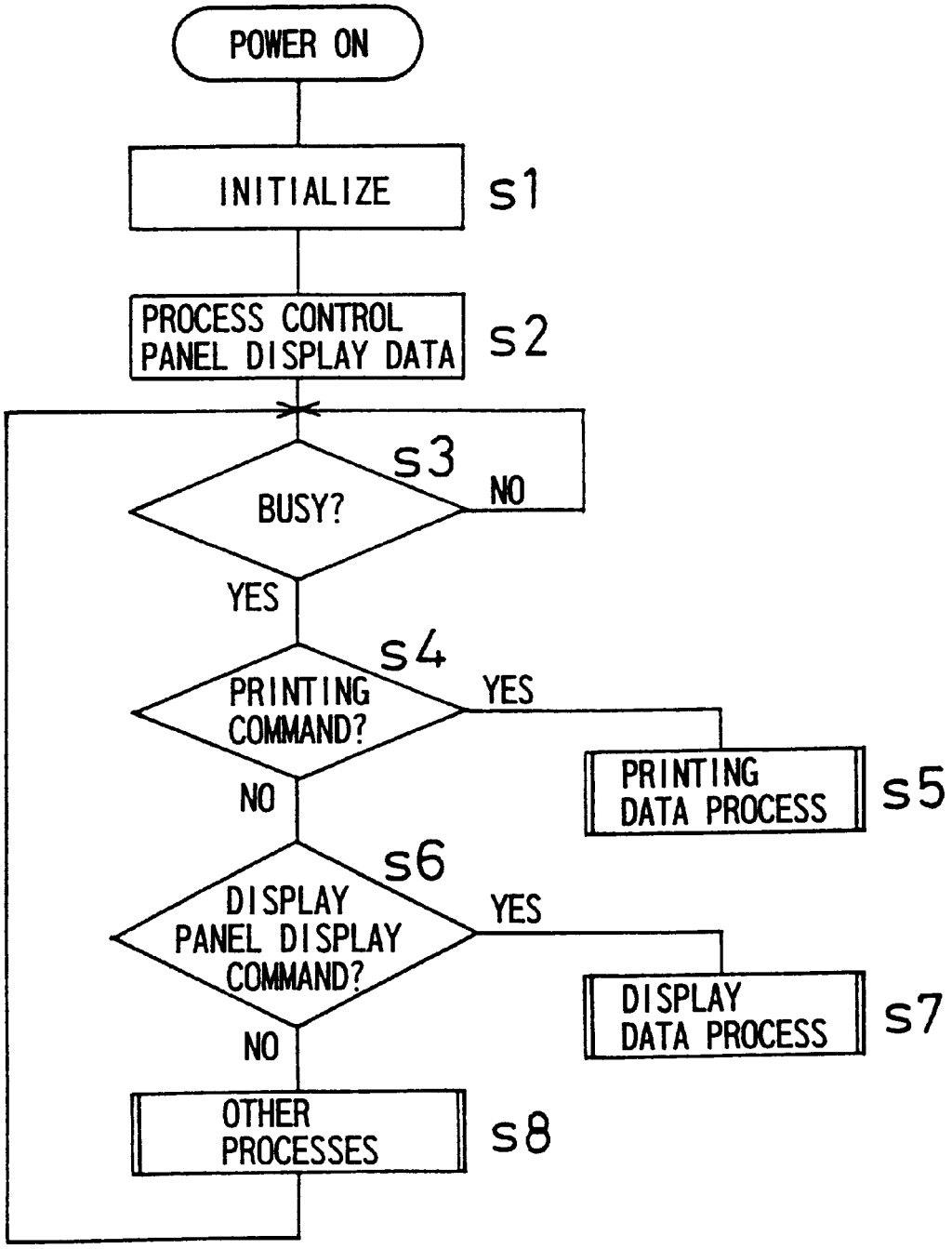
FIG. 8 is a flowchart showing operations of the printer.
Figure 9:
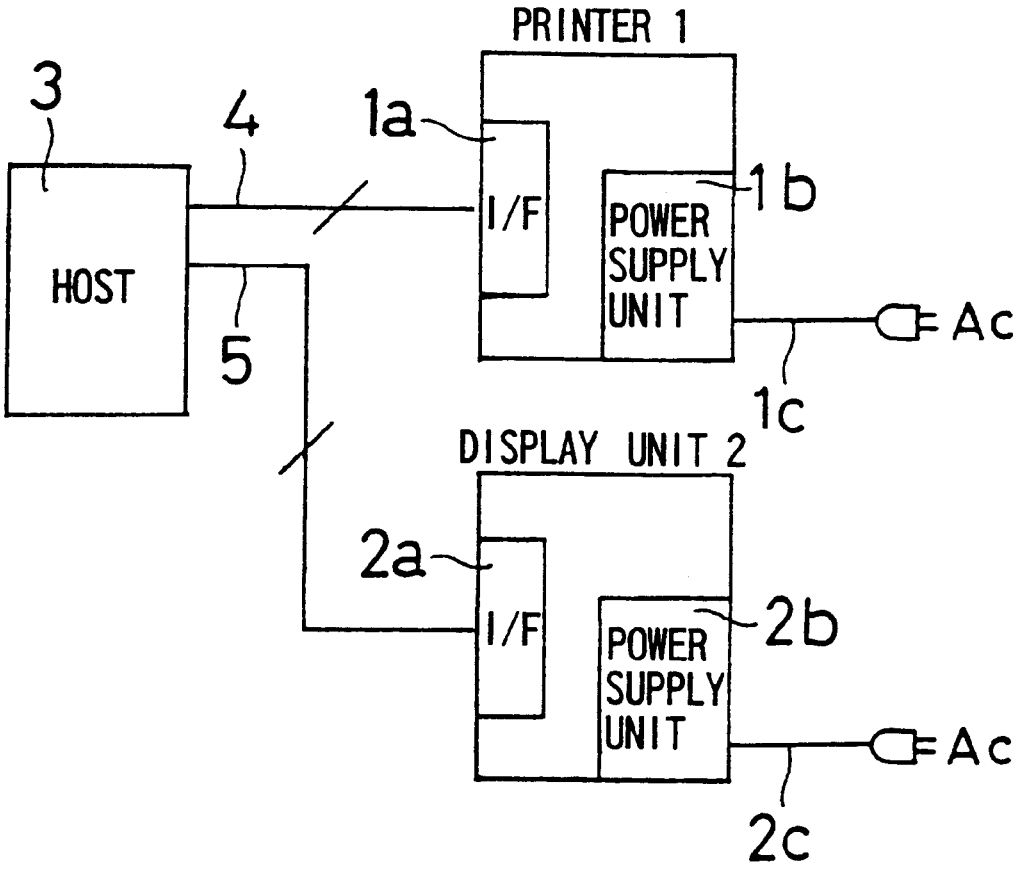
FIG. 9 is a block diagram showing one example of a prior art accounting system.

FIG. 8 is a flowchart showing the operation of the printer. When the power supply of the printer is turned ON, a display data process for displaying the operating state of the printer 80 on the control panel 70 is executed in Step s2 after initializing the printer 80 in Step s1. Next, Step s3 stands by in a loop until when the printer 80 gets in a BUSY state. The printer 80 gets in the BUSY state when it receives some data from the host unit H.

Control commands transmitted by the host unit H are structured in the following format for example.

a) Data transmitting command ESC CR n 1B 0A (where, n=00H (hexadecimal notation), 10H, 03H, 13H)

b) Display panel setting command ESC S c) Display panel releasing command ESC G

In the data transmitting command, the host unit H adds actual data after transmitting the processing code n indicating the data processing contents following to the escape code ESC and the carriage return code CR in the ASCII code. Here, n=00H indicates receipt printing data, n=10H indicates receipt printing and display panel display data, n=03H indicates slip sheet printing data and n=13H indicates slip sheet printing and display panel displaying data.

A combination of the display panel setting command and the display panel releasing command is prepared as display panel dedicated commands. The transmitted actual data is displayed only on the display panel 60 and is not printed when the host unit H transmits the escape code ESC and the character code S, then the actual data and finally the escape code ESC and the character code G.

Next, when the command of the host unit H contains the printing command in Step s4, the process advance to Step s5 to execute a corresponding printing data process. When the command of the host unit H contains a display command of the display panel 60 on the other hand, the process advances to Step s7 to execute the display data process. When the command is a command other than that, the process returns to Step s3 to stand by after executing a corresponding process in Step s8.

Thus, the printer executes the printing process of the cut sheet S, the printing process of the continuous paper L2, the displaying process of the display panel 60 and others solely or concurrently corresponding to the command transmitted from the host unit H. Customers can confirm the printed contents of the cut sheet S or the continuous paper L2 readily and reliably by displaying them on the display panel 60. Further, because the actual data transmitted from the host unit H is used not only for printing but also for display when the code n showing the data processing content is 10H or 13H, it is possible to reduce the burden of the host unit H and to securely prevent disagreement between the printed content and the displayed content from occurring.

Effect of Invention

As described above in detail, according to the present invention, it is possible to display information for the operator of the printer, e.g., paper out, paper jam, on-line and off-line and other information, on the first display section and to display information for a person on the other side such as a customer, e.g., the printed contents such as a merchandise name and price, on the second display section.

Furthermore, by identifying a command type of the data transmitted from the external host unit, it is possible to discriminate among printing data, display data and printing-display data, with the result that the external host unit can transmit display data following the same procedure as that in transmitting printing data and burdens of the operator and the external host unit can be reduced. Also the printer can execute the printing process and the displaying process solely or concurrently in response to such a command.

By integrally providing the printing section, the first display section, the second display section, the first interface section and the second interface section and by connecting the printing section and the second display section by the signal cable and the power cable to determine data on the basis of commands, it is not only possible to downsize and simplify the whole apparatus and reduce the cost thereof, but also to reduce the burden of the host unit and make the printed contents agree securely with the displayed content.

What is claimed is:

1. A printer comprising:

a first interface section operable to electrically connect said printer with an external host unit;

a printing mechanism operable to print on a recording medium;

a printing control section operable to make said printing mechanism operate on a basis of printing data;

a first display section operable to display operating states of said printing mechanism and said printing control section;

a second display section operable to display display data for customers;

a display control section operable to control said second display section;

a data determining section operable to identify a command type of data transmitted from the external host unit to determine the data as being printing data, display data, or common data to be printed and displayed;

a data transmitting section operable to transmit the data to at least one of said printing control section and said display control section according to the command type of the data.

2. A printer as claimed in claim 1, further comprising:

a second interface section operable to electrically connect said printer with said second display section and exchange signals therebetween;

wherein said second display section is detachable from said second interface section.

3. A printer as claimed in claim 2, wherein said printing mechanism contains a first printing unit operable to print on a cut sheet and a second printing unit operable to print on continuous paper.

4. A printer as claimed in claim 1, wherein electric power to said second display section is supplied from a power circuit of a body of said printer.

5. A printer as claimed in claim 4, wherein said printing mechanism contains a first printing unit operable to print on a cut sheet and a second printing unit operable to print on continuous paper.

6. A printer as claimed in claim 1, wherein said printing mechanism contains a first printing unit operable to print on a cut sheet and a second printing unit operable to print on continuous paper.

7. A printer comprising:

a first interface section operable to electrically connect said printer with an external host unit;

a printing mechanism operable to print on a recording medium;

a printing control section operable to make said printing mechanism operate on a basis of printing data;

a first display section operable to display operating states of said printing mechanism and said printing control section;

a second display section operable to display display data for customers;

a display control section operable to control said second display section;

a data determining section operable to identify a command type of data transmitted from the external host unit to determine the data as being printing data, display data, or common data to be displayed and printed;

a data transmitting section operable to transmit same data to both said printing control section and said display control section when the data is determined to be common data to be displayed and printed.

8. A printer as claimed in claim 7, further comprising:

a second interface section operable to electrically connect said printer with said second display section and exchange signals therebetween;

wherein said second display section is detachable from said second interface section.

9. A printer as claimed in claim 8, wherein said printing mechanism contains a first printing unit operable to print on a cut sheet and a second printing unit operable to print on continuous paper.

10. A printer as claimed in claim 7, wherein electric power to said second display section is supplied from a power circuit of a body of said printer.

11. A printer as claimed in claim 10, wherein said printing mechanism contains a first printing unit operable to print on a cut sheet and a second printing unit operable to print on continuous paper.

12. A printer as claimed in claim 7, wherein said printing mechanism contains a first printing unit operable to print on a cut sheet and a second printing unit operable to print on continuous paper.

* * * * *